United States Patent [19]

Albert

[11] Patent Number: 5,075,970

[45] Date of Patent: Dec. 31, 1991

[54] SOUND EMITTING UTENSILS

[75] Inventor: Jeff Albert, Los Angeles, Calif.

[73] Assignee: Ocean Shore Toys, Inc., Los Angeles, Calif.

[21] Appl. No.: 652,777

[22] Filed: Feb. 8, 1991

[51] Int. Cl.[5] ..... A47J 43/28

[52] U.S. Cl. ..... 30/123; 30/322; 30/324

[58] Field of Search ..... 30/142, 324, 322, 123; 340/384 E, 539; 446/297, 81, 397, 419; 272/74, 100, 129, 75; 434/204, 169, 334, 365

[56] References Cited

U.S. PATENT DOCUMENTS

| | | | |
|---|---|---|---|
| 2,126,858 | 8/1938 | Zadek | 446/81 |
| 2,722,153 | 11/1955 | Greco | 30/324 |
| 2,787,055 | 4/1957 | Wertz | 30/324 |
| 2,800,825 | 7/1957 | Toussaint | 446/81 |
| 3,510,643 | 5/1970 | File | 30/123 |
| 3,839,793 | 10/1974 | Crapio | 30/123 |
| 4,207,673 | 6/1980 | DiGirolamo et al. | 30/123 |
| 4,809,335 | 2/1989 | Rumsey | 446/297 |

*Primary Examiner*—Douglas D. Watts
*Assistant Examiner*—Hwei-Siu Payer
*Attorney, Agent, or Firm*—Cooper & Dunham

[57] ABSTRACT

Utensils are provided which incorporate speech synthesis microelectronics. A switch on the exterior of the utensil handle actuates circuitry inside the utensil handle, including a speech synthesizer semi-conductor chip and an amplifier semi-conductor chip. Emulated speech generated by the speech synthesizer semi-conductor chip is processed by the amplifier semi-conductor chip and emitted from the speaker in the utensil.

9 Claims, 2 Drawing Sheets

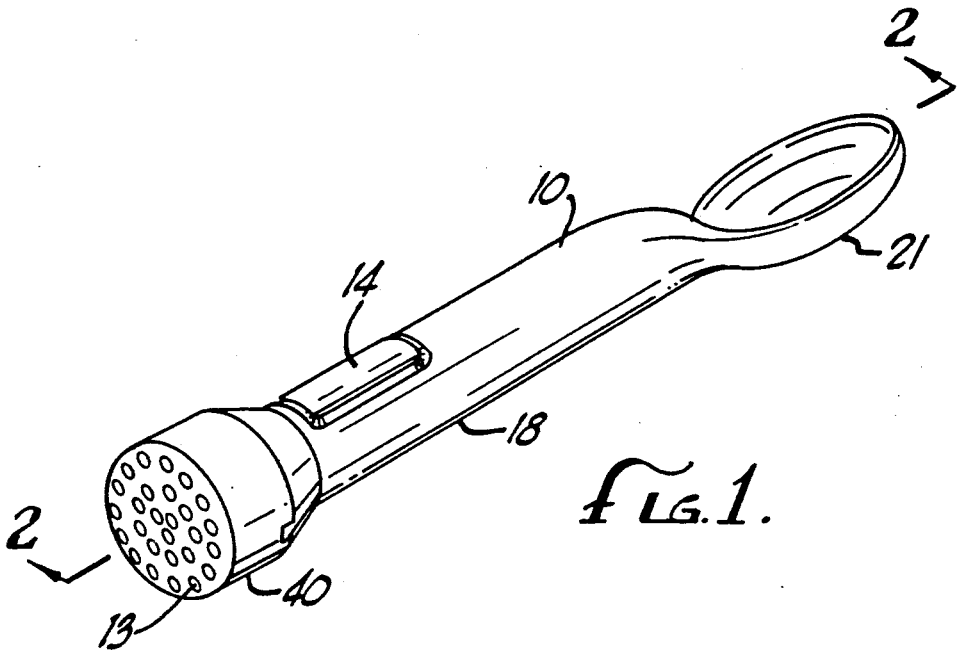
FIG. 1.
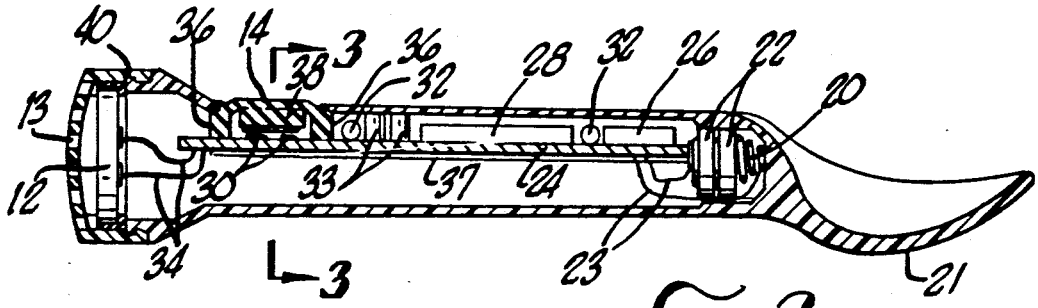
FIG. 2.
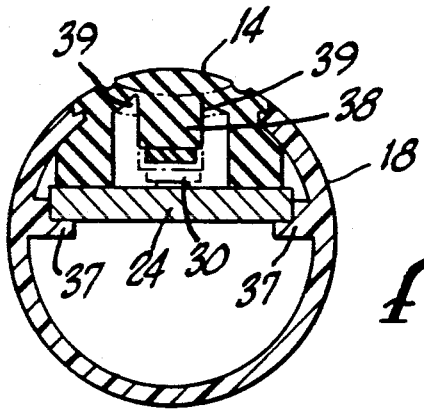
FIG. 3.
FIG. 4.
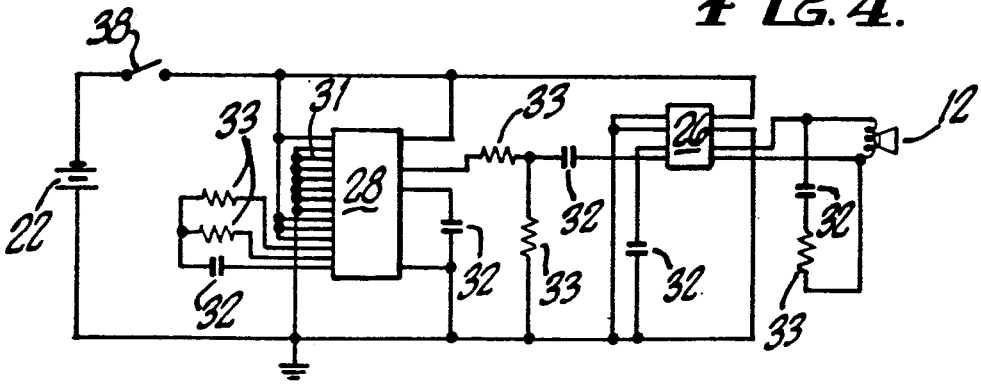

SOUND EMITTING UTENSILS

BACKGROUND OF THE INVENTION

The present invention relates to cutlery which emits a sound emulating the human voice. The invention is useful in teaching children and others proper eating habits, as well as in providing educational information and entertainment to a user during a meal.

Eating utensils which provide sensory cues to a user are known. U.S. Pat. No. 4,207,673 to DiGirolamo et al. discloses a utensil with light or tone-emitting diodes inside the utensil handle, designed to enable the user to develop better eating habits. The light or tone helps a user to eat more slowly.

U.S. Pat. No. 3,839,793 to Crapio discloses a utensil with means for activating lights in a clown face located on the surface of the utensil. U.S. Pat. No. 1,189,897 to Wilkes discloses a child's utensil with a hollow chamber and a striker in the chamber designed to make a rattling noise when the utensil is used. The sensory cues provided by the prior art are limited to simple cues, such as lights and non-speech sounds.

Means for synthesizing human speech also are known. U.S. Pat. No. 4,809,335 to Rumsey utilizes a voice synthesizer to enable speech to be generated from a doll or toy. U.S. Pat. No. 4,857,030 to Rose utilizes speech synthesizer technology to make dolls appear to intelligently converse. The dolls signal to each other via radio transmissions and emit responses in human speech. U.S. Pat. No. 4,810,997 to Kudo et al. discloses a small sound generating device for use in dolls or toys, which generates sound, but does not synthesize human speech.

Heretofore, it has not been known to employ synthesized human speech in small objects, such as cutlery, to provide educational information or entertainment.

SUMMARY OF THE INVENTION

One object of the present invention is to provide a utensil with means for synthesizing human speech.

Another object of the present invention is to provide a utensil that synthesizes human speech and which can safely be handled by children and is easily cleaned.

Still another object of the present invention is to provide speech synthesis technology within small objects such as eating utensils.

In accordance with the present invention, an eating utensil, such as a knife, fork or spoon, has a hollow handle containing speech synthesizing microelectronics. A battery, also within the handle, provides power when a switch on the outside of the handle is actuated, causing a speech synthesizer semi-conductor chip to create pre-programmed human speech. The sound passes through an amplifier semi-conductor chip and is emitted from a speaker attached to the handle.

The invention relates specifically to eating utensils. However, it also is applicable to other eating implements, such as cups and plates.

BRIEF DESCRIPTION OF THE DRAWINGS

FIG. 1 is a perspective view of the utensil of the present invention.

FIG. 2 is a cross-sectional, elevational view of the utensil along line 2—2 of FIG. 1.

FIG. 3 is a cross-sectional, elevational view of the utensil along line 3—3 of FIG. 2.

FIG. 4 is a schematic drawing of the electrical circuit contained in the utensil of the present invention.

DETAILED DESCRIPTION

Figure 5:
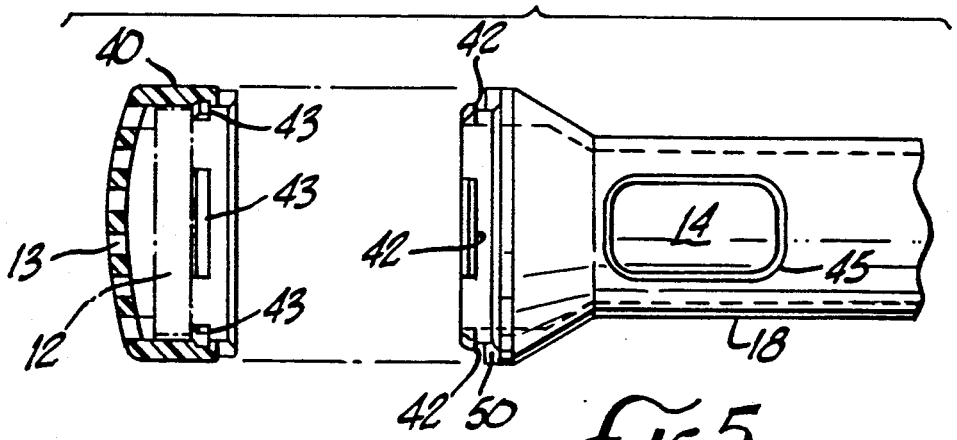
FIG. 5 is a partial, cross-sectional, side elevational view of the handle and speaker housing of the utensil.

Generally, as shown in FIG. 1 of the drawings, the present invention relates to an eating utensil 10 which emits human speech from speaker 12 (not seen in FIG. 1) when switch 14 is depressed. The utensil 10 depicted in FIG. 1 is a spoon, but the invention applies as well to forks, knives and other types of cutlery. Handle 18 of utensil 10 is a hollow, tubular object. In a preferred embodiment, utensil 10 is formed from a waterproof plastic.

As best seen in FIG. 2, a battery or batteries 22 are mounted inside handle 18, directly rearward of utensil head 21. Battery 22 engages and is in contact with battery spring 20. Battery leads 23 are connected to battery 22 at one end and to a circuit board 24 at the opposite end. Circuit board 24 rests on ledges 37 which are longitudinally disposed within hollow handle 18. Amplifier semi-conductor chip 26, synthesizer semi-conductor chip 28, switch mounts 36, and switch contacts 30 are mounted on circuit board 24. Also mounted on circuit board 24 are capacitors 32 and resistors 33, not all of which are visible in FIG. 2. Speaker wire 34 is connected to circuit board 24 at one end and to speaker 12 at the opposite end.

Speaker housing 40 containing speaker 12 is detachably connected to handle 18. Speaker 12 is placed into speaker housing 40 such that the front of speaker 12 faces toward speaker holes 13. Speaker holes 13 are dispersed throughout the rear of speaker housing 40. Speaker 12 forms a seal across speaker housing 40.

In another embodiment, speaker 12 can be positioned inside speaker housing 40 such that the front of speaker 12 faces toward utensil head 21. This embodiment creates a baffle around speaker 12 which increases the resonance and clarity of the sound emitted from speaker 12. This embodiment also eliminates the need for speaker holes 13 and the possibility of water damage to speaker 12 when the utensil is used or washed.

In still another embodiment, speaker 12 is placed inside speaker housing 40 so that the front of speaker 12 faces the closed end of speaker housing 40. Speaker housing 40 is elongated, crating a baffle around speaker 12 which increases the resonance and clarity of sound emitted from speaker 12. In this embodiment, there also is no need for speaker holes 13 and water damage to speaker 12 is less likely to occur.

Figure 7:
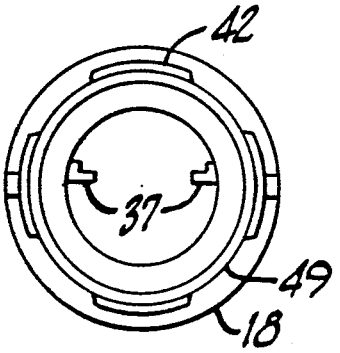
FIG. 7 is a cross-sectional, elevational view of the handle along line 7—7 of FIG. 6.

As shown in FIGS. 3 and 7, circuit board 24 is insertable inside hollow handle 18 of utensil 10 and rests on ledges 37 formed longitudinally within handle 18, such that switch knife 38 is positioned over switch contacts 30 and is supported by switch mounts 36. Switch mounts 36 provides a flexible, water-tight seal at slot 45 between handle 18 and switch 14. Switch 14 is directly above switch knife 38. Switch leaf springs 39 are attached to switch mounts 36 and are in contact with switch 14. When switch 14 is depressed, switch springs 39 contract, causing switch knife 38 to engage switch contacts 30, to thereby actuate the speech synthesizer circuit. Other suitable switches also may be used in the device of the invention.

FIG. 4 shows a schematic diagram of the electrical circuitry of the present invention. The circuit comprises switch knife 38, speech synthesizer semi-conductor chip 28, pin connectors 31, amplifier semi-conductor chip 26, capacitors 32, resistors 33, battery 22 and speaker 12.

Figure 6:
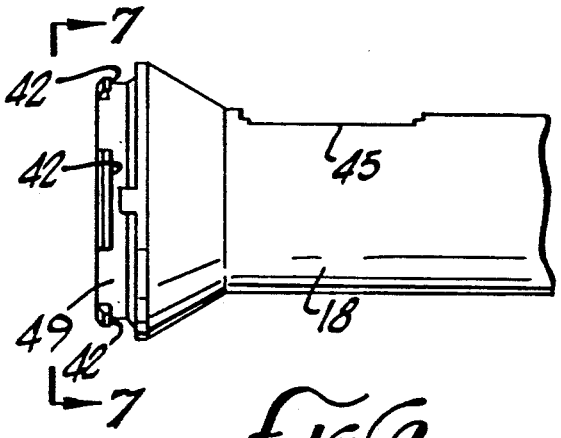
FIG. 6 is a partial side view of the handle of the utensil with the speaker housing removed.

As shown in FIGS. 5 and 6, speaker housing 40 is detachably connected to handle 18 via a bayonet fitting 42. The fitting 42 comprises lugs 43 disposes along rim 49 of handle 18 adapted to engage grooves 44 at rim 50 of speaker housing 40. When engaged, speaker housing 40 and handle 18 have a water-tight connection. Other suitable connections, such as screw fittings, also may be used.

Figure 8:
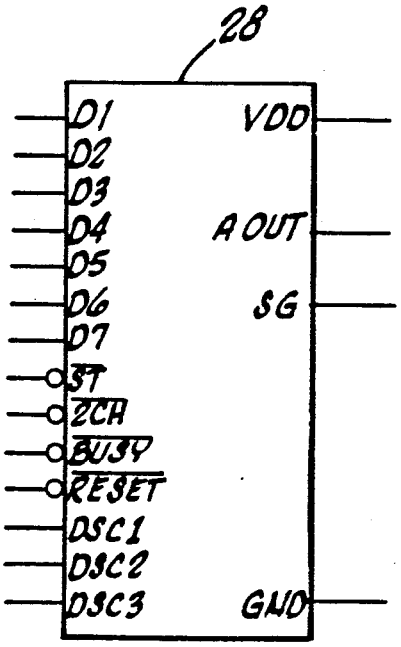
FIG. 8 is a drawing of the pin assignments for the speech synthesizer semi-conductor chip.
Figure 9:
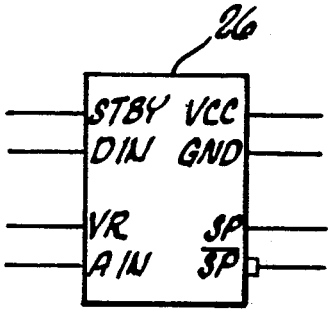
FIG. 9 is a drawing of the pin assignments for the amplifier semi-conductor chip.

The pin assignments for speech synthesis semi-conductor chip 28 which generates voice commands are shown in FIG. 8. The pin assignments for amplifier semi-conductor chip 26 which generates speaker commands are shown in FIG. 9.

In use, switch 14 is depressed, causing switch springs 39 to contract and switch knife 38 to contact switch contacts 30, thereby completing the electrical circuit. Switch knife 38 and slot 45 may be arranged such that switch 14 is depressed by a user only when he or she holds utensil 10 properly, thus enforcing proper eating skills. Completion of the electrical circuit connects battery 20 to the electrical circuit, described in connection with FIG. 4, causing power to be applied to speech synthesizer semi-conductor chip 28. Upon the introduction of electrical power, speech synthesizer semi-conductor chip 28 resets and begins to execute programmed code. Speech synthesizer chip 28 generates an analog voice signal according to its program and emits a pre-programmed voice signal. The analog voice signal is bandpass filtered and imputed to amplifier semi-conductor chip 26 where it is processed. The differential output from amplifier semi-conductor chip 26 is connected directly to speaker 12 which emits sound.

Speech synthesizer semi-conductor chip 28 can be preprogrammed to generate any desired message in human speech. The speech synthesizer semi-conductor chip 28 described herein preferably is of the type manufactured by OKI Semi-Conductor Inc. and is available with read-only memory (style number MSM6373) or one time programmable read-only memory (style number MSM6378). The chip has a built-in digital to analog converter, and a low-pass filter. However, other suitable speech synthesizer semi-conductor chips also may be used.

Amplifier semi-conductor chip 26 described herein preferably is of the type made by OKI Semi-Conductor Inc. and designated style number MSC1191. Again, other suitable amplifier semi-conductor chips may be used with the invention. The amplifier semi-conductor chip is designed to be connected directly to speaker 12 by differential outputs of amplifier semi-conductor chip 26.

In one embodiment of the invention, the speech program runs continuously while switch 14 is actuated. Speech synthesizer semi-conductor chip 28 also can be programed such that the finite voice program plays once for each momentary engagement of switch 14, and does not require continuous engagement of the switch.

In one embodiment of the invention, battery 22 is located inside handle 18, near utensil head 21, such that it cannot be tampered with or removed. Although this arrangement renders utensil 10 safe for children, it is more difficult to change battery 22. In another embodiment, battery 22 and battery springs 20 can be relocated to a position inside handle 18 which enables battery 22 to be changed more readily when necessary, but does not provide a safety feature.

The utensil 10 is constructed such that it is water-tight. Thus, utensil 10 may be hand-washed after use without interfering with the electrical circuitry.

It should be appreciated that the specification and drawings depict one presently preferred embodiment of the invention. Other changes and modifications may be made, as would be apparent to those skilled in the art, without departing from the spirit and scope of the invention. For example, the invention may be embodied in plates, bowls and cups, as well as in utensils, or in other small objects, such as toothbrushes and hair brushes.

I claim:

1. A utensil which emits emulated human speech, comprising:

a. a hollow tube terminating in a utensil head at one end;

b. a power source fitted inside said tube;

c. a speech synthesizer semi-conductor chip fitted inside said tube and connected by electrical circuit means to said power source;

d. an amplifier semi-conductor chip fitted inside said tube and connected by electrical circuit means to said speech synthesizer semi-conductor chip; and e. speaker means fitted inside said tube and connected by electrical circuit means to said amplifier semi-conductor chip, whereby when power generated by said power source is introduced to said speech synthesizer semi-conductor chip, emulated human speech is generated, processed through said amplifier semi-conductor chip and emitted from said speaker means.

2. The utensil of claim 1, further comprising a switch mounted on the exterior of said tube and connected by electrical circuit means to said power source.

3. The utensil of claim 2, further comprising means for generating, continuous synthesized speech.

4. The utensil of claim 2, further comprising means for generating, finite synthesized speech.

5. The utensil of claim 1, wherein said tube is a handle and said handle and said utensil head form a sealed, water-tight implement.

6. The utensil of claim 1, wherein said utensil head is a fork.

7. The utensil of claim 1, wherein said utensil head is a spoon.

8. The utensil of claim 1, wherein said utensil head is a knife.

9. The utensil of claim 1, wherein said speaker means is fitted inside said tube at an end opposite said utensil head.

* * * * *